US006014776A

United States Patent [19]

DeVinzio

[11] Patent Number: 6,014,776

[45] Date of Patent: Jan. 18, 2000

[54] BANDANNA-LIKE HEADPIECE

[76] Inventor: John J. DeVinzio, 956 Broadway Ave., East Mckeesport, Pa. 15035

[21] Appl. No.: 09/225,435

[22] Filed: Jan. 5, 1999

[51] Int. Cl.[7] ..... A42B 5/00

[52] U.S. Cl. ..... 2/207; 171/172

[58] Field of Search ..... 2/171, 172, 207

[56] References Cited

U.S. PATENT DOCUMENTS 5,594,956 1/1997 Barrientos ..... 2/207

*Primary Examiner*—Diana Oleksa

*Attorney, Agent, or Firm*—James Ray & Associates

[57] ABSTRACT

A decorative head piece comprising an elongated strip piece of cloth having a fastener at each end so that the two ends of the strip piece of cloth can be joined together to form a closed loop that can be fitted around a person's head, and a generally hemispherical piece of cloth permanently attached to a top edge of the strip piece of cloth such that the hemispherical piece of cloth will overlay the person's head when said closed loop is fitted therearound, the hemispherical piece of cloth has a tail, or tapered end portion adapted to hang downwardly overlaying the fastener when joined together.

5 Claims, 3 Drawing Sheets

BANDANNA-LIKE HEADPIECE

FIELD OF THE INVENTION

The present invention relates, in general, to decorative headpieces and, more particularly, to a cloth headpiece resembling a bandanna, when worn, which can be fitted onto the head without the need for tying the head piece in place.

BACKGROUND OF THE INVENTION

Bandannas have long been known as decorative headpieces normally comprising a square or rectangular piece of cloth which can be worn on a person's head by tying the bandanna onto the head pursuant to either of two different methods. One method is to drape the bandanna over the top of the head so that two exposed ends hanging downwardly at the sides can be tied together under the chin, while another method is to wrap the bandanna with an edge across the forehead with the ends extending rearward and tied together behind the head. By either technique, two ends of the bandanna must be tied together to secure it onto one's head, so that it is secured onto the head only as well as it can be tied.

SUMMARY OF THE INVENTION

The present invention provides a shaped cloth headpiece which resembles a bandanna when worn, but does not have to be tied onto the head. Rather the headpiece of this invention provides an elongated strip piece of cloth having opposing ends which can be joined together with snaps, hook and loop fastener, or the like, to form a closed loop so that the strip piece can merely be slipped over the top of one's head without the possibility of becoming untied. A generally hemispherical top piece of cloth is sewn or otherwise attached to the strip piece at the front and two sides such as to be disposed over the top of the head when the looped strip piece is placed around the head. To provide the appearance of a bandanna, the generally hemispherical top piece is provided with a tail portion extending rearwardly and adapted to hang downwardly over or under the joined ends of the strip piece.

OBJECTS OF THE INVENTION

It is, therefore, one of the primary objects of the present invention to provide a headpiece resembling a cloth bandanna in appearance but comprising in part a closed loop of cloth which can be fitted over the head.

Another primary object of this invention is to provide a headpiece resembling a cloth bandanna in appearance that does not have to be tied onto the head.

Still another primary object of this invention is to provide a unique and novel headpiece resembling a cloth bandanna in appearance.

These and other objects and advantages of the present invention may become more readily apparent to those persons who are skilled in the headpiece art from the following more detailed description of the invention, particularly, when such detailed description is taken in conjunction with the attached drawing Figures and with the appended claims.

BRIEF DESCRIPTION OF THE PRESENTLY PREFERRED EMBODIMENTS OF THE INVENTION

Figure 1:
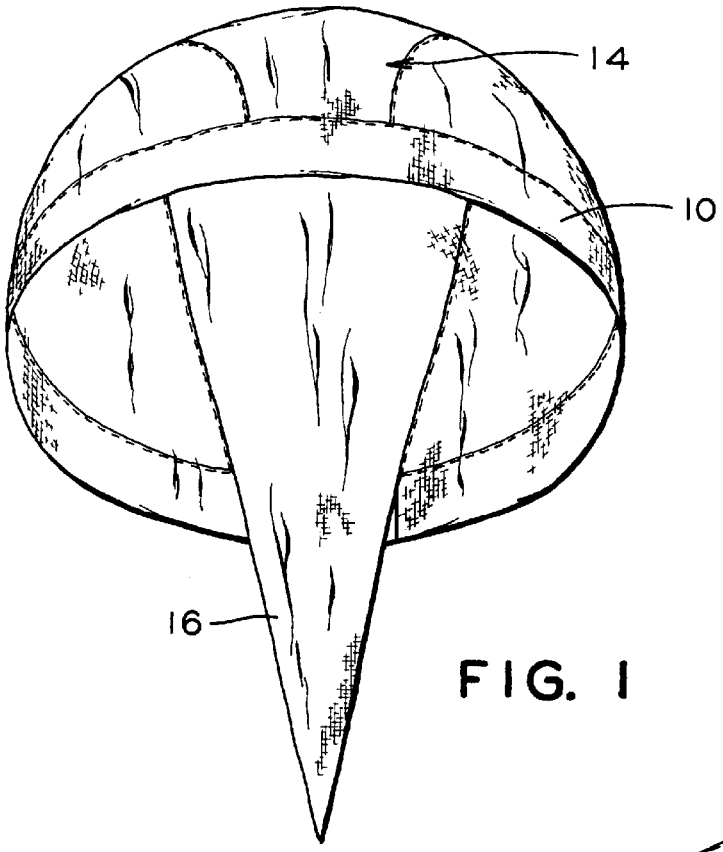
FIG. 1 is a perspective frontal view of a headpiece pursuant to a preferred embodiment of this invention as seen looking upward thereto.
Figure 2:
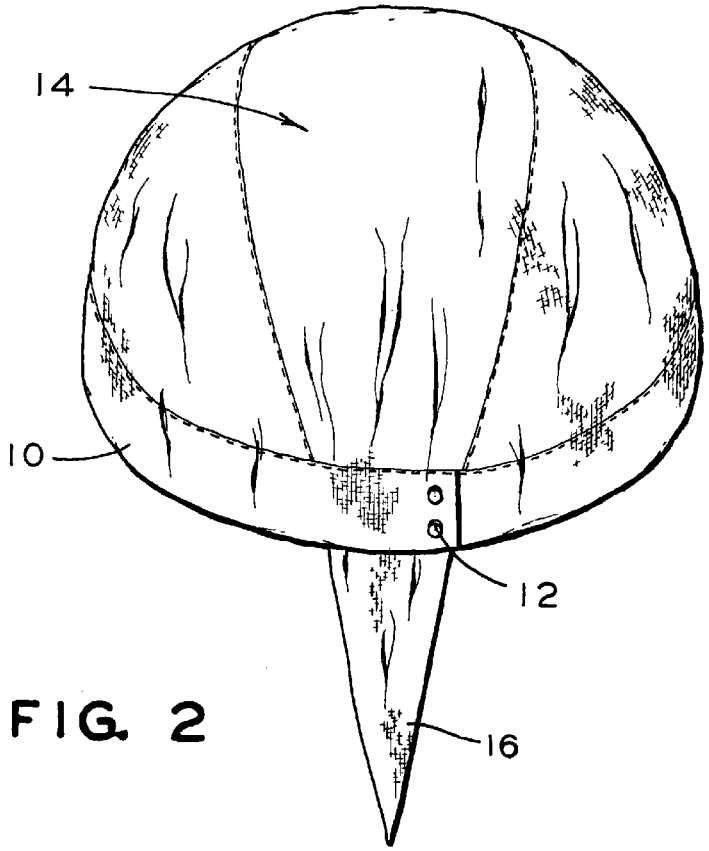
FIG. 2 is a perspective frontal view of the headpiece shown in FIG. 1 as seen looking downward thereto.
Figure 3:
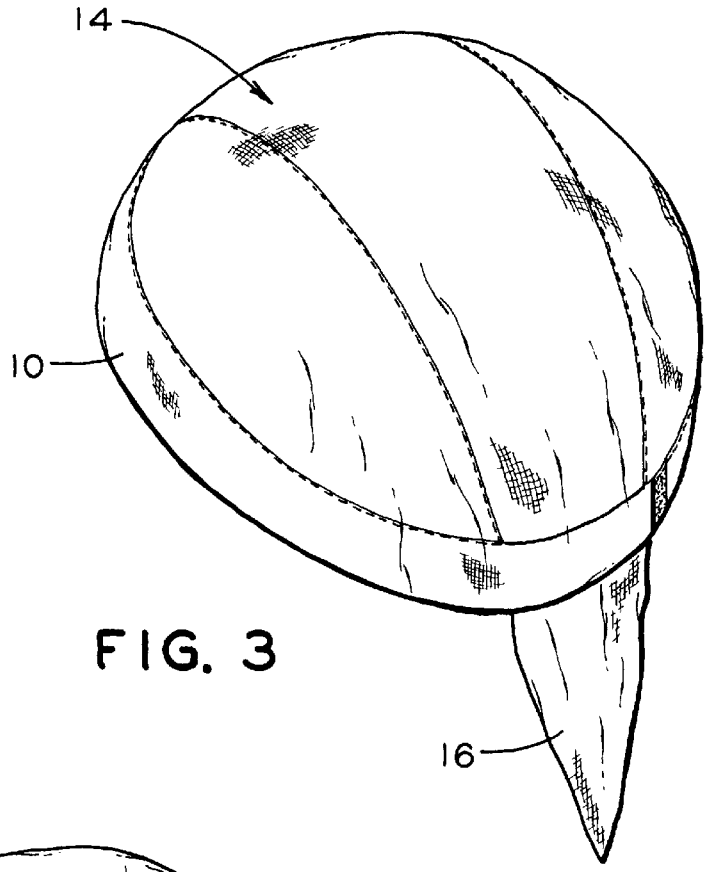
FIG. 3 is a perspective view of the headpiece shown in FIGS. 1 and 2 as seen looking downward thereon from the left-rear.
Figure 4:
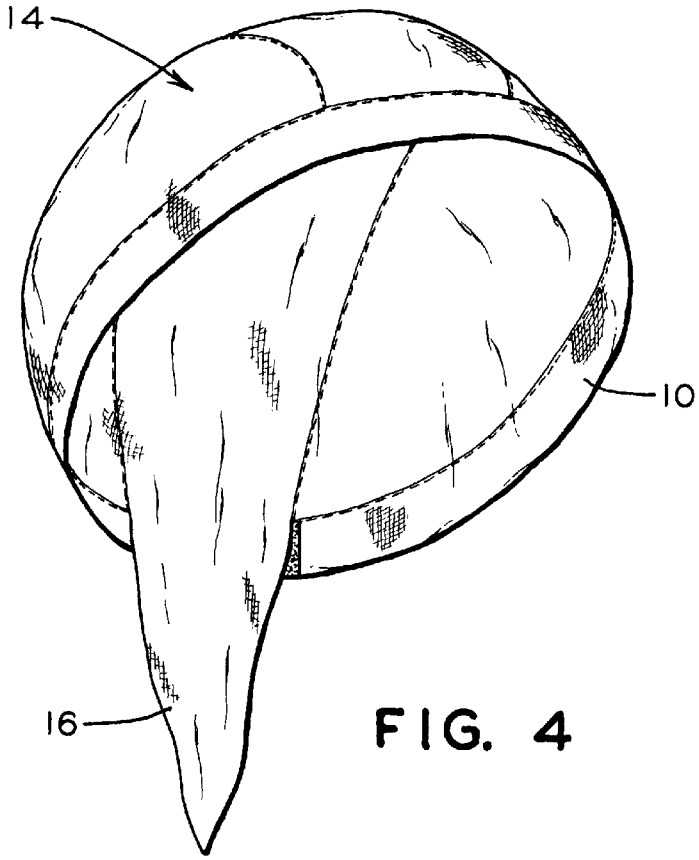
FIG. 4 is a perspective view of the headpiece shown in FIGS. 1–3 as seen looking upward into the opening from the right front.
Figure 5:
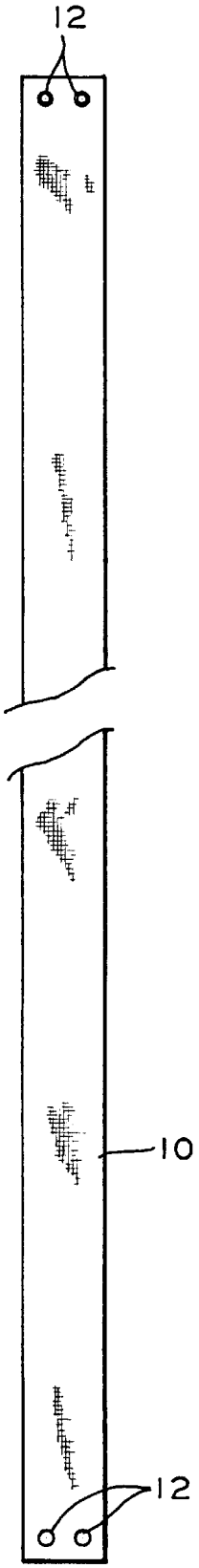
FIG. 5 is a plan view of the strip piece of cloth laid out flat without the generally hemispheric piece attached thereto.

Prior to proceeding to the more detailed description of the present invention, it should be noted that for the sake of clarity in understanding the invention, identical components with identical functions have been designated with identical reference numerals throughout the drawing Figures.

With reference to the drawings, the headpiece of this invention comprises an elongated strip piece of cloth 10 having fastener means 12 at each end so that the two ends of the strip piece 10 can be joined together to form a closed loop that can be fitted around a person's head, and a generally hemispherical piece of cloth 14 sewn or otherwise attached to a top edge of strip piece 10 such that the hemispherical piece of cloth 14 will overlay the person's head when said closed loop is fitted therearound. The generally hemispherical piece of cloth 14 is provided with a tail or tapered end portion 16 which is not secured to strip piece 10, but rather extends between the ends of strip piece 10 so that it is adapted to hang downwardly overlaying fastener means 12 when joined together.

Figure 7:
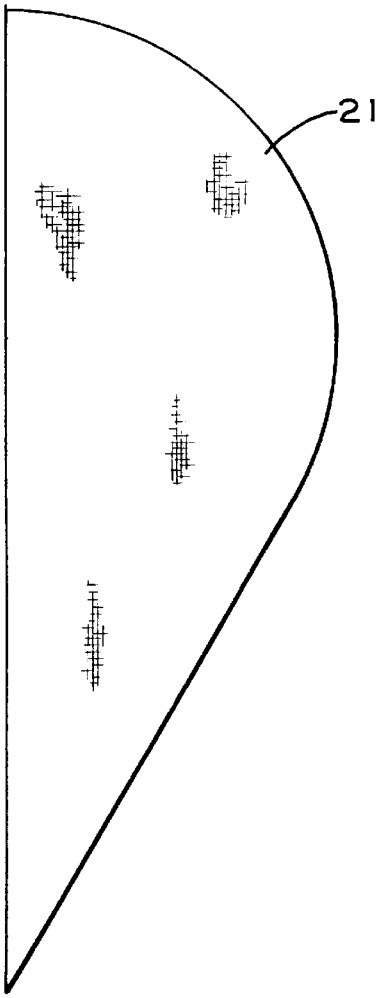
FIG. 7 is a plan view of the two side portions of the generally hemispherical pieces.
Figure 6:
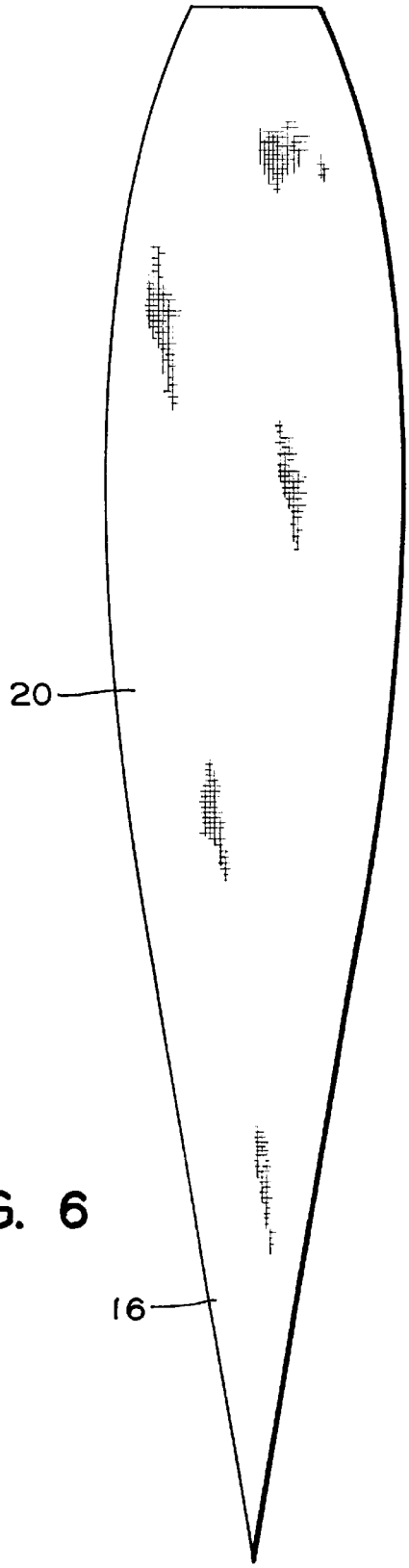
FIG. 6 is a plan view of center portion of the generally hemispherical piece.

While there are a number of different methods that could be used to form the shape of generally hemispherical piece 14, one method I have used is to cut a piece of cloth 20 in the shape as shown in FIG. 6, wherein the center piece is in the shape of a tear-drop having tapered side portions and then sewing a generally half circular piece of cloth 21, as shown in FIG. 7, to each side thereof. As shown, the two half-circular pieces 21 have tapered sides which are not sewn to the adjacent tapered end portion 16, so that tapered end portion 16 will extend downwardly between the two half-circular pieces 20.

While a preferred embodiment of the headpiece of the present invention has been described in detail above, it should be apparent to persons having ordinary skills in art that various other embodiments, adaptations and modifications of the invention could be made without departing from the spirit and scope of the invention. As noted above, for example, there are a number of different methods that could be used to form the generally hemispherical piece 14, such as joining a plurality of wedge pieces at a common axis. Indeed, other modifications and embodiments could be utilized without departing from the spirit and scope of the invention.

I claim:

1. A decorative head piece comprising an elongated strip piece of cloth having a fastener means at each end so that the two ends of the strip piece of cloth can be joined together to form a closed loop that can be fitted around a person's head, and a generally hemispherical piece of cloth permanently attached to a top edge of said strip piece of cloth such that the generally hemispherical piece of cloth will overlay the top portion of a person's head when said closed loop is fitted therearound, and such that the closed loop and hemispherical portion fit tightly against the persons head, said hemispherical piece of cloth having a tail, or tapered end portion adapted to hang downwardly adjacent to said fastener means when joined together.

2. A decorative head piece according to claim 1 in which said fastener means are snaps.

3. A decorative head piece according to claim 1 in which said fastener means are a pair of hook and loop fasteners.

4. A decorative head piece according to claim 1 in which said generally hemispherical piece of cloth is formed by sewing two generally half-circular pieces of cloth to a center piece of cloth, said center piece of cloth having a pair of tapered side porions extending rearwardly to form said tail portion.

5. A decorative head piece comprising an elongated strip piece of cloth having a fastener means at each end so that the two ends of the strip piece of cloth can be joined together to form a closed loop that can be fitted around a person's head, and a generally hemispherical piece of cloth permanently attached to a top edge of said strip piece of cloth such that the hemispherical piece of cloth will overlay the person's head when said closed loop is fitted therearound, said hemispherical piece of cloth formed by sewing two generally half-circular pieces of cloth to a center piece of cloth, said center piece of cloth being having tapered side portions to which said generally half-circular pieces are joined and having an end portion adapted to hang downwardly adjacent to said fastener means when joined together.

* * * * *